US012098532B1

(12) United States Patent
Carmona

(10) Patent No.: US 12,098,532 B1
(45) Date of Patent: Sep. 24, 2024

(54) PORTABLE PERSONAL URINAL

(71) Applicant: Michael B. Carmona, Agoura Hills, CA (US)

(72) Inventor: Michael B. Carmona, Agoura Hills, CA (US)

( * ) Notice: Subject to any disclaimer, the term of this patent is extended or adjusted under 35 U.S.C. 154(b) by 0 days.

(21) Appl. No.: 18/748,593

(22) Filed: Jun. 20, 2024

Related U.S. Application Data

(60) Provisional application No. 63/522,080, filed on Jun. 20, 2023.

(51) Int. Cl.
*E03D 13/00* (2006.01)

(52) U.S. Cl.
CPC ..... *E03D 13/007* (2013.01)

(58) Field of Classification Search
CPC ..... E03D 13/00; E03D 13/05; E03D 13/007; E03D 11/143; E03D 11/146; E03D 11/12
USPC ..... 4/300, 144.1, 462, 463, 252.3, 645
See application file for complete search history.

(56) References Cited

U.S. PATENT DOCUMENTS

| | | | | |
|---|---|---|---|---|
| 9,605,420 | B1 * | 3/2017 | Berger | E03D 13/00 |
| 2007/0056082 | A1 * | 3/2007 | Scheel | E03D 13/00 4/144.1 |
| 2014/0143944 | A1 * | 5/2014 | Jose | A47K 11/12 4/144.1 |
| 2020/0217058 | A1 * | 7/2020 | Dragomir | E03D 13/00 |

* cited by examiner

*Primary Examiner* — Tuan N Nguyen
(74) *Attorney, Agent, or Firm* — QuickPatents; Kevin Prince

(57) ABSTRACT

A portable personal urinal device designed for home use provides a practical and hygienic solution for urination. The device features a vertical standing support with a base equipped with lockable casters for mobility. An upper reservoir for water is attached near the top of the support, with ports for water introduction and removal. Below this, a urine receptor with a height adjustment mechanism includes a bowl and a waste liquid reservoir. The device facilitates fluid communication between the bowl and the reservoir through conduits equipped with valve mechanisms for controlling water flow and waste disposal. Additional functionalities include a movable top cover for the receptor, integrated pumps for water and waste management, and optional features such as a toilet paper holder and a deodorizer in the water reservoir. This invention addresses hygiene, convenience, and aesthetic appeal, making it suitable for diverse user needs and settings.

18 Claims, 4 Drawing Sheets

PORTABLE PERSONAL URINAL

CROSS REFERENCE TO RELATED APPLICATIONS

This application claims the benefit of U.S. Provisional Patent Application No. 63/522,080, filed on Jun. 20, 2023, and incorporated herein by reference.

STATEMENT REGARDING FEDERALLY SPONSORED RESEARCH AND DEVELOPMENT

Not Applicable.

FIELD OF THE INVENTION

This invention relates to urinals, and more particularly to a portable personal urinal designed for home use with features for water conservation and enhanced hygiene.

BACKGROUND

Personal urinals have been a staple in public restrooms, particularly in men's restrooms, for many years. These fixtures are typically wall-mounted and designed for standing use, providing a convenient and efficient means of urination. The design of these urinals often includes a drain connected to a plumbing system for waste disposal and a flush mechanism for rinsing the urinal after use.

In addition to public restrooms, personal urinals have also found application in medical settings, where handheld urine collectors are commonly used for bedridden patients.

These handheld devices are typically portable and designed for single use, with a container for collecting urine and a spout or opening for easy disposal of the collected urine.

Despite the widespread use of these urinals, their application has largely been limited to public restrooms and medical settings. In the home setting, the standard fixture for urination is typically the toilet, which is designed for both urination and defecation. The use of toilets for urination, however, can often result in splashing and dribbling onto the floor, walls, and toilet seat, leading to unsanitary conditions.

Furthermore, standard toilets typically use a substantial amount of water for flushing, which can be wasteful, particularly when used for urination alone. This has led to a growing interest in water conservation and the development of fixtures and devices that use less water.

Despite these considerations, the concept of a personal urinal for home use has not been widely adopted, and the available solutions do not adequately address the issues of cleanliness and water conservation.

Therefore, there is a pressing demand for a device that addresses the drawbacks of the prior art by providing a private, in-home urinal that is not just functional, but also aesthetically pleasing as a bathroom accessory. Such a device would ideally be portable, adjustable, and easy to clean, thereby eliminating the mess and unsanitary conditions often associated with male urination. It would also be designed to conserve water, using a fraction of the amount typically used by standard toilets for flushing. The present invention accomplishes these objectives.

SUMMARY OF THE INVENTION

The present invention pertains to a portable personal urinal device designed to offer a practical and hygienic solution for urination, particularly suitable for home use. This device combines functionality with aesthetic appeal, incorporating various features that enhance its usability and ease of maintenance.

The device includes a vertical standing support that extends from an upper end to a lower end, terminating at a base equipped with lockable casters. This allows the device to be easily moved across a horizontal surface. An upper reservoir for water is fixed near the upper end of the support, featuring an open top port for water introduction and an open bottom port for water removal.

Below the upper reservoir, a urine receptor is attached to the support. This receptor includes a height adjustment mechanism, allowing for vertical adjustment relative to the support. The receptor comprises a bowl and a waste liquid reservoir below the bowl. Water or urine introduced into the bowl falls by gravity into the waste liquid reservoir, which has a lower port for the removal of waste water and urine.

Fluid communication between the bowl of the urine receptor and the bottom port of the upper reservoir is established through an upper conduit. This conduit includes a first valve mechanism that controls the flow of water from the upper reservoir into the bowl. A lower conduit connects the lower port of the waste liquid reservoir to an open lower end and includes a second valve mechanism that manages the flow of waste water and urine from the waste liquid reservoir.

Additional features may include a top cover for the urine receptor that can be moved between a closed and an open position, a first pump in the first valve mechanism for actively pumping water, and a second pump in the second valve mechanism for actively pumping waste water. The device may also include a toilet paper holder and a deodorizer disinfectant in the clean water reservoir, enhancing the convenience and hygienic conditions of the bathroom environment.

The present invention provides a comprehensive solution that addresses the needs for hygiene, convenience, and aesthetic appeal in personal urination devices, making it suitable for a wide range of users and settings. The present invention provides a unique solution that not only eliminates the mess and unsanitary conditions often associated with male urination but also significantly conserves water. Unlike traditional methods, which often involve either using a standard toilet or less hygienic alternatives, the present device introduces a novel approach to personal urination, not only for males but also for females. It offers a private, in-home urinal that is not only functional but also aesthetically pleasing as a bathroom accessory. Designed to be portable, adjustable, and easy to clean, the device enhances the user experience while promoting environmental sustainability through reduced water usage. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
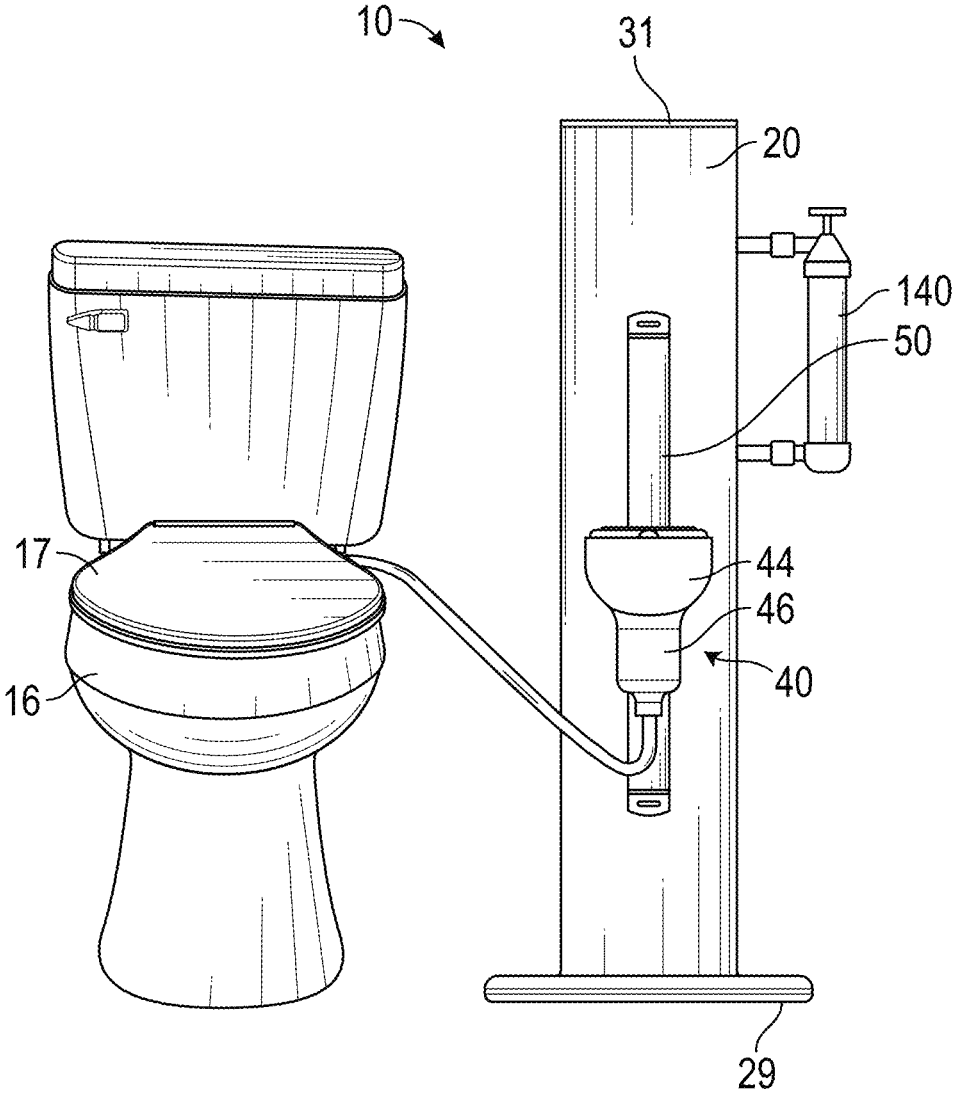
FIG. 1 is a front elevational view of the invention, illustrating its use with a toilet bowl in a home setting.
Figure 3:
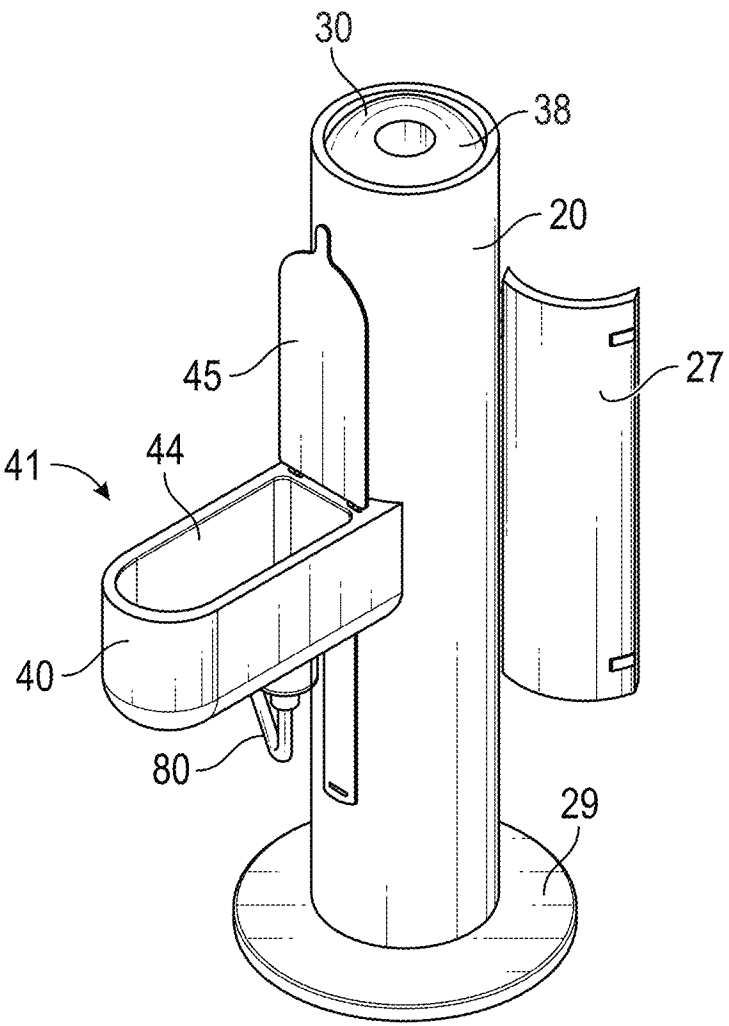
FIG. 3 is a front perspective view of the invention, illustrated with the urine receptor between the fully raised position and a fully lowered position, and with the top cover in an open position, and with an upper reservoir lid removed to expose an upper reservoir.

FIGS. 1-5 illustrate a portable personal urinal device 10 designed to provide a convenient and hygienic solution for urination, particularly in a home setting (FIG. 1). The device 10 is structured to be both functional and aesthetically pleasing, incorporating various features that enhance usability, sanitation, and maintenance.

The portable personal urinal device 10 comprises a vertical standing support 20, which extends from an upper end 28 to a lower end 22, terminating at a base 29. The base 29 may be equipped with a plurality of lockable casters 130 (FIG. 5), allowing the device 10 to be easily rolled across a horizontal surface 15, such as a bathroom or bedroom floor, and then locked in place to prevent rolling of the device 10 during use. The support 20 and base 29 can be constructed from durable materials such as stainless steel or reinforced plastics, which provide stability and resistance to corrosion.

An upper reservoir 30 for water is fixed proximate the upper end 28 of the support 20 and features an open top port 38 for the introduction of water and an open bottom port 32 for the removal of water. The upper reservoir 30 can be made from materials such as high-density polyethylene (HDPE) or acrylic, known for their durability and resistance to water damage.

Below the upper reservoir 30, a urine receptor 40 is fixed with the support 20. This urine receptor 40 includes a height adjustment mechanism 50, allowing for the vertical positioning of the urine receptor 40 relative to the support 20. The urine receptor 40 comprises a bowl 44 with a volume $V_1$ and a waste liquid reservoir 46 below the bowl 44 with a volume $V_2$. Water or urine introduced into the bowl 44 fall by gravity into the waste liquid reservoir 46. Materials suitable for the urine receptor 40 and its components include ceramics, stainless steel, or antimicrobial plastics, which help maintain cleanliness and resist odor.

An upper conduit 60 (FIG. 5) establishes fluid communication between the bowl 44 of the urine receptor 40 and the open bottom port 32 of the upper reservoir 30. The upper conduit 60 includes a first valve mechanism 70 that controls the flow of water from the upper reservoir 30 into the bowl 44. The upper conduit 60 can be made from silicone or other flexible, water-resistant materials, as is known in the art.

A lower conduit 80 (FIG. 1) connects the lower port 42 of the waste liquid reservoir 46 to an open lower end 82. This conduit 80 includes a second valve mechanism 90 that manages the flow of waste water and urine from the waste liquid reservoir 46. The materials used for the lower conduit 80 are resistant to corrosion and bacterial growth, such as PVC or silicone, as is known in the art.

The vertical standing support 20 may include an open internal space 25 (FIG. 5) for containing the upper reservoir 30 and portions of the height adjustment mechanism 50, enhancing the compactness and integration of the device 10. A support door 27 may be included for allowing access to the upper reservoir 30 and the height adjustment mechanism 50.

The first valve mechanism 70 may include a first pump 140 that actively pumps water from the upper reservoir 30 into the bowl 44 when activated. The first pump 140 can be manually actuated by hand or foot, or electrically actuated, providing flexibility in operation. When activated, the first pump 140 achieves the open position 72 as it actively pumps water from the upper reservoir 30 into the bowl 44. When deactivated, the first pump 140 achieves the closed position 71 and prevents water from flowing from the upper reservoir 30 into the bowl 44.

Similarly, the second valve mechanism 90 may incorporate a second pump 150 that actively pumps waste water from the waste liquid reservoir 46 out of the open lower end 82 of the lower conduit 80 when activated. The second pump 150 can also be either manually actuated by hand or foot, or electrically actuated, depending on user preference and design considerations. The first pump 140 and the second pump 150 may be taken from a wide variety of manually actuated or electrically activated pumps, as is known in the art. When activated, the second pump 150 achieves the open position 92 as it actively pumps waste water and urine from the waste liquid reservoir 46 out of the open lower end 82 of the lower conduit 80. When deactivated, the second pump 150 achieves the closed position 91 and prevents water from flowing from the waste liquid reservoir 46 out of the open lower end 82 of the lower conduit 80. In embodiments having electrical pumps 140,150, a suitable power source is included (not shown), as is known in the art.

In use, the portable personal urinal device 10 is positioned by a user (not shown) near a toilet bowl 16 or other suitable drainage area using the lockable casters 130 on the base 29 for easy mobility. The user adjusts a height of the urine receptor 40 to a comfortable level using the height adjustment mechanism 50. Once positioned, the user can urinate into the bowl 44 of the urine receptor 40. After use, the first valve mechanism 70, which may be manually or electrically actuated, is triggered to allow water from the upper 19 reservoir 30 to flush urine down into the waste liquid reservoir 46 below the bowl 44. This flushing process is facilitated by the upper conduit 60 connecting the bowl 44 to the upper reservoir 30. When the waste liquid reservoir 46 is full, or after each use, if desired, the second valve mechanism 90 is activated to release the contents into the toilet or drainage area through the lower conduit 80. This mechanism also can be manually or electrically operated, ensuring that all waste is efficiently expelled from the device 10, maintaining hygiene and ease of use while also conserving water.

For efficient disposal of the contents from the waste liquid reservoir 46, the open lower end 82 of the lower conduit 80 can be strategically inserted between the toilet bowl 16 and a toilet seat 17 (FIG. 1). This positioning allows the waste water and urine to be directly discharged into the toilet bowl 16 when the second valve mechanism 90 is opened. The placement of the open lower end 82 ensures that the waste is contained and does not spill or splash outside the toilet bowl 16, maintaining cleanliness and hygiene in the bathroom environment. A retention clip (not shown) can be used to fix the open lower end 82 of the lower conduit 80 with the toilet bowl 16. This method of disposal is particularly advantageous as it utilizes existing bathroom infrastructure, making the process of emptying the device 10 seamless and straightforward. Additionally, this setup minimizes the need for further handling or transferring of waste, thereby enhancing the overall user experience and maintaining sanitary conditions. The retention clip may also be used to hold the open lower end 82 of the lower conduit 80 in a raised position on the vertical standing support 20 while the device 10 is moved from one location to another.

The urine receptor 40 may include a top cover 45 that moves between a closed position 49, covering the bowl 44, and an open position 41 (FIG. 3) that uncovers the bowl 44 for use. The top cover 45 helps maintain hygiene by minimizing exposure of the bowl 44 when not in use, and provides an improved aesthetic to the home setting.

Figure 4:
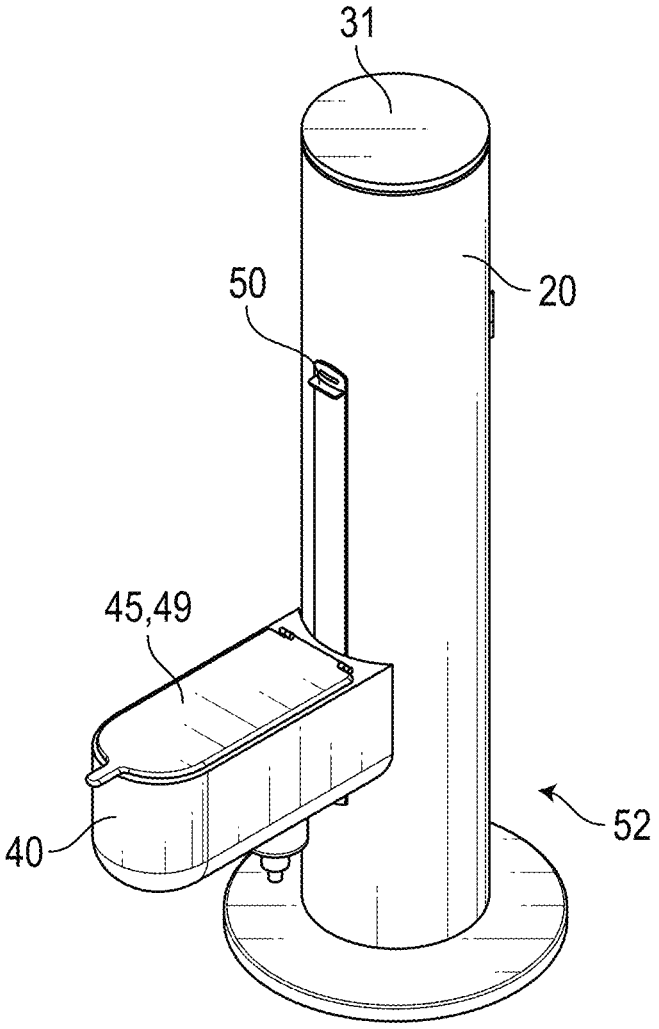
FIG. 4 is a front perspective view of the invention, illustrated with the urine receptor in a fully lowered position.

The height adjustment mechanism 50 may include an actuator 55 (FIG. 5), possibly biased with a spring mechanism 160 to urge the actuator 55 into a non-actuated position, to facilitate easy adjustment of the urine receptor 40 height. When actuated, the actuator allows the urine receptor 40 to be moved between a fully raised position 58 (FIG. 2) below the upper reservoir 30, and a fully lowered position 52 (FIG. 4). When in the non-actuated position, the actuator 55 prevents movement of the urine receptor 40.

Figure 2:
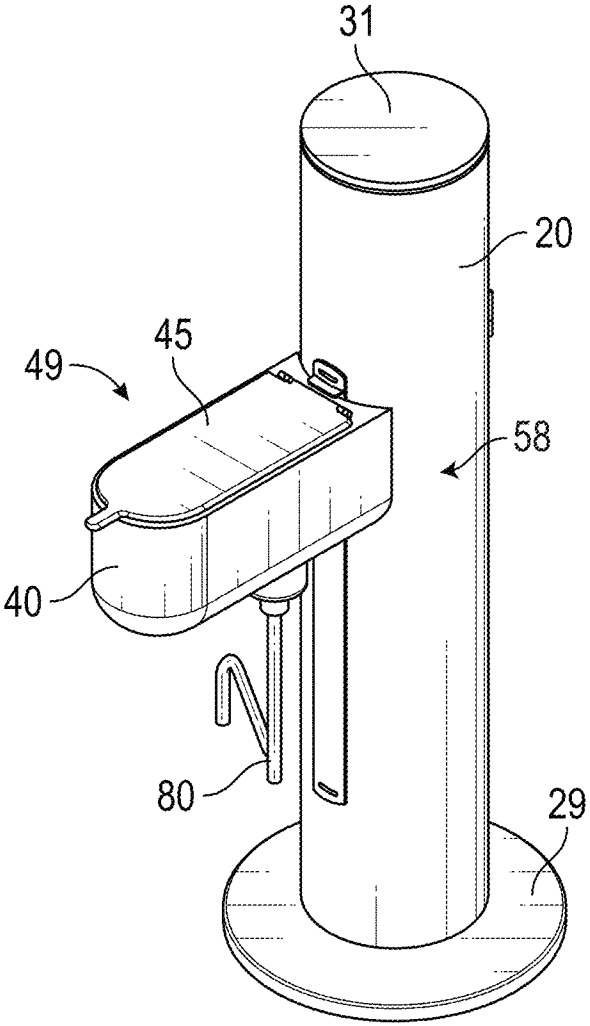
FIG. 2 is a front perspective view of the invention, illustrated with a urine receptor in a fully raised position and with a top cover in a closed position.
Figure 5:
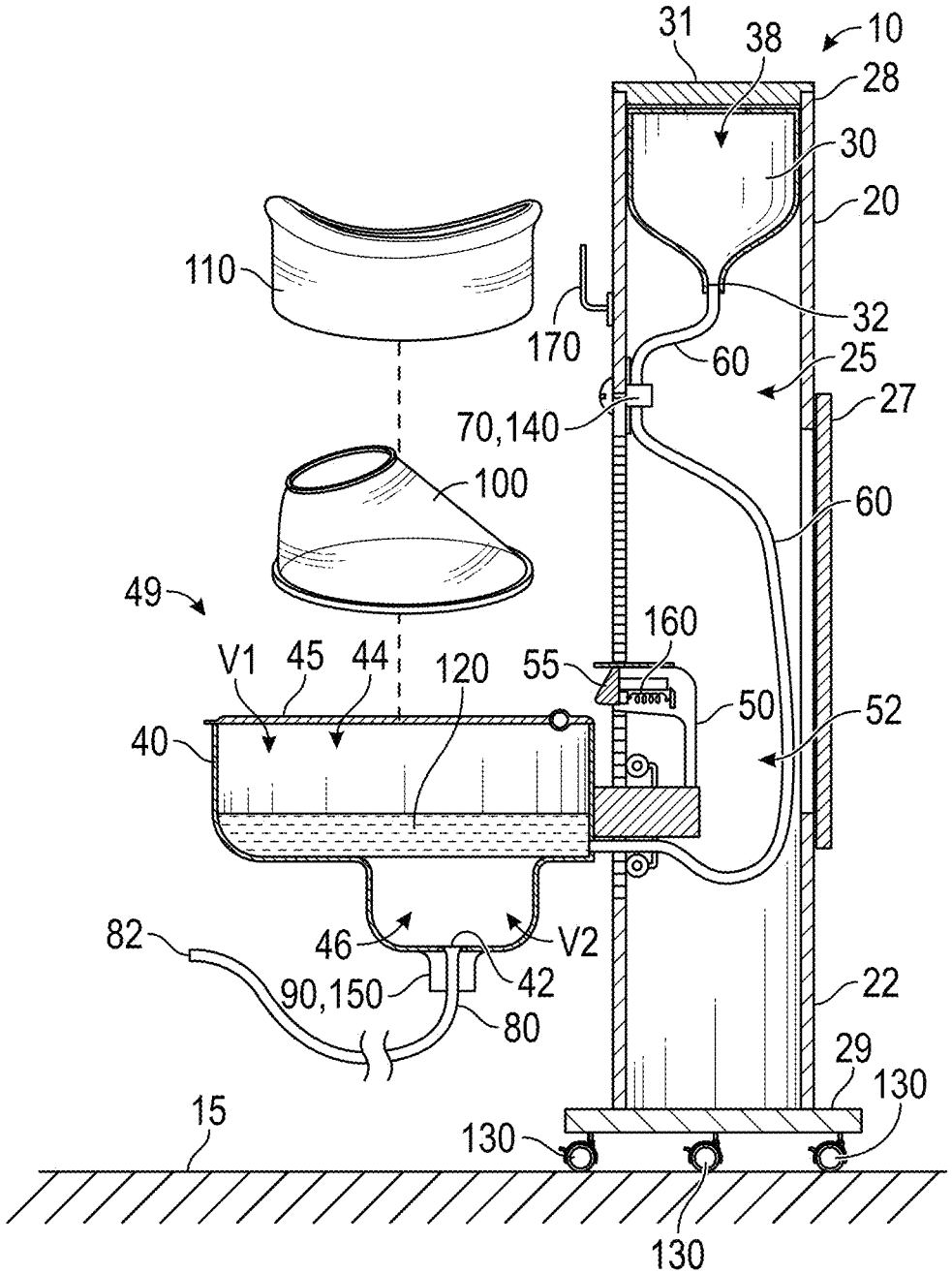
FIG. 5 is a cross-sectional diagram of the invention, illustrating an open internal space within a vertical support structure, and upper conduit, and a diagrammatical representation of a height adjustment mechanism.

The open top port 38 of the upper reservoir 30 may be sealed with a lid 31 to prevent contamination and evaporation of the stored water. The lid 31 may be incorporated the upper end 28 of the vertical standing support 20 as illustrated in FIGS. 2, 4 and 5.

The bowl 44 of the urine receptor 40 may take the appearance of a standard oval shaped urinal or include form-fitting adapters (FIG. 5), such as a male form-fitting adapter 100 and a female form-fitting adapter 110, enhancing user comfort and effectiveness in directing urine flow. These adapters 100,110 are configured to receive a pubic area of male and female users, respectively, helping to reduce urine splash outside of the device 10. Such adapters 100,110 are preferably removable and easily cleaned. Disposable or cleanable inserts (not shown) may also be included for guests' usage.

The bowl 44 also includes a perforated ring 120 in communication with the upper conduit 80 and through which water is introduced. The perforated ring 120 is made from materials such as stainless steel, other corrosion-resistant alloys, or bio-resistant plastics.

Preferably the perforated ring 120 is selectively removable from the bowl 44 for facilitating cleaning of the bowl 44. The perforated ring 120 may also include a bottom side 125 that prevents larger items such as toilet paper or cigarettes from entering the waste liquid reservoir 46.

The device 10 may also include a toilet paper holder 170 (FIG. 5) attached to the vertical standing support 20, providing convenience and space efficiency. The toilet paper holder 170 can be affixed to a top or side of the device 10 for easy accessibility, enhancing the user experience by integrating essential bathroom functionalities into a single unit.

The device 10 may also incorporate a deodorizer disinfectant (not shown) in the upper reservoir 30, contributing to a more hygienic and odor-free environment. This feature ensures that the device 10 not only maintains cleanliness but also enhances the overall bathroom atmosphere. Similarly, scented urinal cakes (not shown) or the like can be maintained within the bowl 44, as is known in the art.

While a particular form of the invention has been illustrated and described, it will be apparent that various modifications can be made without departing from the spirit and scope of the invention. For example, while the drawings illustrate the portable personal urinal device 10 having a cylindrical vertical standing support, other shapes could be utilized such as a square column (not shown). Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description."While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A portable personal urinal device, comprising:

a vertical standing support having an upper end and a lower end terminating at a base;

an upper reservoir for water fixed proximate the upper end of the support and having an open top port through which water may be introduced, and an open bottom port through which water may be removed;

a urine receptor fixed with the support below the upper reservoir, the urine receptor having a height adjustment mechanism for raising or lowering the urine receptor with respect to the support, the urine receptor having a bowl having a bowl volume and a waste liquid reservoir below the bowl and having a waste liquid reservoir volume, water or urine introduced into the bowl falling by gravity into the waste liquid reservoir, the waste liquid reservoir having a lower port through which waste water and urine can be removed;

an upper conduit in fluid communication with the bowl of the urine receptor and the bottom port of the upper reservoir, the upper conduit including a first valve mechanism configured for preventing water from flowing from the upper reservoir into the bowl in a closed position, and for allowing water to flow from the upper reservoir into the bowl in an open position; and a lower conduit in fluid communication with the lower port of the waste liquid reservoir at an upper end and an open lower end, the lower conduit including a second valve mechanism configured for preventing waste water and urine from flowing from the waste liquid reservoir through the lower conduit in a closed position, and for allowing waste water and urine to flow from the waste liquid reservoir out of the open lower end of the lower conduit in an open position;

whereby with the open lower end of the lower conduit inserted into a toilet bowl, a user may urinate into the urine receptor and then actuate the first valve mechanism to flush the urine, and then when the waste liquid reservoir is full after several uses, actuate the second valve mechanism to empty the waste liquid reservoir into the toilet bowl.

2. The portable personal urinal device of claim 1 wherein the vertical standing support includes an open internal space for containing the upper reservoir.

3. The portable personal urinal device of claim 1 wherein the first valve mechanism includes a first pump that, when activated, achieves the open position and further actively pumps water from the upper reservoir into the bowl, and when deactivated, achieves the closed position and prevents water from flowing from the upper reservoir into the bowl.

4. The portable personal urinal device of claim 3 wherein the first pump is a manually actuated pump.

5. The portable personal urinal device of claim 3 wherein the first pump is an electrically actuated pump.

6. The portable personal urinal device of claim 1 wherein the second valve mechanism includes a second pump that, when activated, achieves the open position and further actively pumps water from the waste liquid reservoir out of the open lower end of the lower conduit, and when deactivated, achieves the closed position and prevents water from flowing from the waste liquid reservoir through the lower conduit.

7. The portable personal urinal device of claim 6 wherein the second pump is a manually actuated pump.

8. The portable personal urinal device of claim 6 wherein the second pump is an electrically actuated pump.

9. The portable personal urinal device of claim 1 wherein the urine receptor includes a top cover that can be moved between a closed position to cover the bowl, and an open position to uncover the bowl for use.

10. The portable personal urinal device of claim 1 wherein the height adjustment mechanism includes an actuator that, when actuated, allows the urine receptor to be moved between a fully raised position below the upper reservoir, and a fully lowered position, and when not actuated prevents movement of the urine receptor.

11. The portable personal urinal device of claim 10 wherein the actuator is biased with a spring mechanism to urge the actuator into a non-actuated position to prevent movement of the urine receptor.

12. The portable personal urinal device of claim 1 wherein the open top port of the upper reservoir includes a lid for sealing the open top port.

13. The device of claim 1, wherein the bowl of the urine receptor takes an appearance a standard oval shaped urinal.

14. The device of claim 1, wherein the bowl of the urine receptor includes a male form-fitting adapter for receiving a pubic area of a male user.

15. The device of claim 1, wherein the bowl of the urine receptor includes a female form-fitting adapter for receiving a pubic area of a female user.

16. The device of claim 1, wherein the bowl includes a perforated ring in fluid communication with the upper conduit and through which the water is introduced into the bowl, the perforated ring being made of a material resistant to corrosion and bacterial growth.

17. The device of claim 1 wherein the base includes a plurality of lockable casters, whereby the portable personal urinal device may be rolled on a horizontal surface.

18. A portable personal urinal device, comprising:

a vertical standing support having an upper end and a lower end terminating at a base with a plurality of lockable casters, whereby the portable personal urinal device may be rolled on a horizontal surface;

an upper reservoir for water fixed proximate the upper end of the support and having an open top port through which water may be introduced, and an open bottom port through which water may be removed, wherein the open top port includes a lid for sealing the open top port;

a urine receptor fixed with the support below the upper reservoir, the urine receptor having a height adjustment mechanism for raising or lowering the urine receptor with respect to the support, wherein the urine receptor includes a bowl having a bowl volume and a waste liquid reservoir below the bowl having a waste liquid reservoir volume, water or urine introduced into the bowl falling by gravity into the waste liquid reservoir, the waste liquid reservoir having a lower port through which waste water and urine can be removed, the bowl including a top cover that can be moved between a closed position to cover the bowl, and an open position to uncover the bowl for use;

an upper conduit in fluid communication with the bowl of the urine receptor and the bottom port of the upper reservoir, the upper conduit including a first valve mechanism configured for preventing water from flowing from the upper reservoir into the bowl in a closed position, and for allowing water to flow from the upper reservoir into the bowl in an open position, wherein the first valve mechanism includes an electrically actuated pump that, when activated, achieves the open position and further actively pumps water from the upper reservoir into the bowl, and when deactivated, achieves the closed position and prevents water from flowing from the upper reservoir into the bowl;

a lower conduit in fluid communication with the lower port of the waste liquid reservoir at an upper end and an open lower end, the lower conduit including a second valve mechanism configured for preventing waste water and urine from flowing from the waste liquid reservoir through the lower conduit in a closed position, and for allowing waste water and urine to flow from the waste liquid reservoir out of the open lower end of the lower conduit in an open position, wherein the second valve mechanism includes an electrically actuated pump that, when activated, achieves the open position and further actively pumps water from the waste liquid reservoir out of the open lower end of the lower conduit, and when deactivated, achieves the closed position and prevents water from flowing from the waste liquid reservoir through the lower conduit; and the bowl including a perforated ring in fluid communication with the upper conduit and through which the water is introduced into the bowl, the perforated ring being made of a material resistant to corrosion and bacterial growth;

whereby with the open lower end of the lower conduit inserted into a toilet bowl, a user may urinate into the urine receptor and then actuate the first valve mechanism to flush the bowl of urine, and then when the waste liquid reservoir is full, raise the urine receptor above the toilet bowl and actuate the second valve mechanism to empty the waste liquid reservoir into the toilet bowl.

* * * * *